United States Patent [19]

Musschoot et al.

[11] Patent Number: 4,545,509

[45] Date of Patent: Oct. 8, 1985

[54] BIN ACTIVATOR APPARATUS

[75] Inventors: Albert Musschoot; Richard B. Kraus, both of Barrington, Ill.

[73] Assignee: General Kinematics Corporation, Barrington, Ill.

[21] Appl. No.: 463,711

[22] Filed: Feb. 4, 1983

[51] Int. Cl.[4] ..... B65G 65/40

[52] U.S. Cl. ..... 222/198; 222/181; 222/199

[58] Field of Search ..... 222/161, 180, 181, 185, 222/196, 198, 199, 200, 408, 460, 461, 504, 544

[56] References Cited

U.S. PATENT DOCUMENTS

| | | | |
|---|---|---|---|
| 3,261,508 | 7/1966 | Wahl | 222/199 |
| 3,407,972 | 10/1968 | Cymbalisty | 222/196 |
| 3,733,012 | 5/1973 | Grun | 222/193 |
| 3,853,247 | 12/1974 | Wahl | 222/199 |
| 4,105,143 | 8/1978 | Blinn | 222/161 |
| 4,285,447 | 8/1981 | Fairbank | 222/200 |

*Primary Examiner*—Joseph J. Rolla
*Assistant Examiner*—Michael S. Huppert
*Attorney, Agent, or Firm*—Wood, Dalton, Phillips, Mason & Rowe

[57] ABSTRACT

A bin activator apparatus is provided for depiling or unpiling a mass of material from a bin or hopper. The activator apparatus is mounted below the bin or hopper on resilient supports and is adapted to arrest material flow when the apparatus is at rest. A unique structure is provided for producing a circular orbital vibratory motion substantially in the plane of the outlet opening of the activator apparatus which motion produces a steady flow of material from the bin or hopper through the apparatus and onto a conveyor or the like.

10 Claims, 7 Drawing Figures

BIN ACTIVATOR APPARATUS

BACKGROUND OF THE INVENTION

This invention relates to bins or hopper discharge apparatus and more particularly to a vibrating bin discharge apparatus.

THE PRIOR ART

Vibratory bin discharge apparatus have been known and used for many years. The apparatus is designed to eliminate the three persistant problems of solids flowing from storage; namely, bridging, ratholing (coring) and classification of the solids in the bin. Bin discharge apparatus is on the market which addresses the problem of moving solids from a bin so as to avoid bridging and/or ratholing but resulted in classifying the solids in the bin. Another bin discharge apparatus was designed with the intent to eliminate classifying of the solids being stored. Both such devices met with limited success but have failed to completely solve the problem of moving stored materials reliably and readily without hang-ups. The above apparatus and others on the market are mounted on the bin, and through brute force vibratory motion applied directly to the shell of the discharge apparatus, promote flow from the bin through the shell.

Other devices on the market vibrate a cone-shaped discharge shell mounted on the bin using the same brute force vibratory motion to promote flow from the bin. Materials used with this later type device generally flow fairly freely so that the activator is energized only when the flow appears to be slowing down or stopping due to bridging or the like. An intermittent activator of this type does not provide a uniform discharge and necessitates frequent starting and stopping of the equipment which is expensive and can reduce the life of the apparatus.

SUMMARY OF THE INVENTION

According to the present invention, a hopper or bin is provided with a discharge activator apparatus which includes a bowl-shaped member overlapping the discharge outlet of the bin and has an outlet opening centrally disposed therein. The discharge apparatus is resiliently mounted on supports and has means for supporting a deflector above the outlet opening with the outer edges of the deflector being concentrically disposed with respect to the discharge opening in the bin and being in radially overlapping relationship with respect to the outlet opening. A vibration generating unit is mounted on the bowl-shaped member by means of a ring-shaped exciter supporting the vibration generator diametrically opposite a counterweight. Plural resilient means support the exciter on the bowl-shaped member such that the center of gravity of the bin activator falls on a vertical axis of the bowl-shaped member at a point between the bowl-shaped member and the deflector. The vibration generator will provide a circular orbital vibratory motion in the plane containing the outlet opening in the bowl-shaped member and at the same time will create a somewhat pitching type vibratory motion about the center of gravity of the bowl-shaped member which will provide a radially outwardly directed force to material on the deflector and will provide a radially inwardly directed force to material on the bowl-shaped member. When the vibration generator is at rest, the material from the bin or hopper will form an angle of repose between the periphery of the deflector and the surface of the bowl-shaped member outward of the outlet opening thereby arresting flow from the outlet opening. The angle of repose will depend upon the type of material in the bin, the coefficient of friction of the surface of the bowl-shaped member, and the vertical spacing between the edges of the deflector and the surface of the bowl-shaped member. The coefficient of friction of the surface of the bowl-shaped member relative to the tangential angle of the bowl-shaped member should be such that the material will not flow relative to the bowl-shaped member without vibration.

When the vibration generator is operating, the circular orbital motion of the vibrator and exciter member will provide the material on the bowl-shaped member with a cyclonic motion creating a vortex-like flow toward the outlet opening. The pitching-type motion about the center of gravity of the apparatus will cause the surface of the deflector above the center of gravity to vibrationally pitch radially outward in a way as to provide vibratory motion to the materials of the bin, which vibratory motion will urge the material radially outward from the deflector toward the opening into the bowl-shaped member. At the same time, the pitching motion below the center of gravity will urge the material on the bowl-shaped member toward the outlet opening which, when combined with the circular orbital motion, will contribute further to the cyclonic motion moving the material in the vortex-like flow toward the outlet opening.

The bin activator apparatus has been found to be operative on all types of material from coal to powders and can be used in dimensions varying from under a few feet in diameter up to 18 or more feet in diameter.

The bin activator apparatus in a preferred form uses a two-mass system where the one mass is the bowl-shaped structure with the other mass being the exciter and vibration generator, with the axis of the rotors of the vibration generator being vertical. Springs between the exciter and the sleeve on the bowl-shaped member are radial and are mounted in such a way as to create a motion that is translational and circular such that each radius of the element is momentarily a feeder feeding material in the bowl toward the outlet opening. When the amplitude and/or frequency of the vibratory motion is increased, the conveying action is increased and will not compact the material in the bin or hopper. The slope of the concave surface of the bowl together with the coefficient of friction of the concave surface are such as to prevent the material from sliding statically, therefore the angel of repose principle becomes effective. In a modification, the surface of the bowl can be cone-shaped provided that the angle of the cone is shallow enough with respect to the horizontal to provide an angle of repose of the material that will fall short of the outlet opening when the vibrator is at rest, thereby cutting off the flow of material.

DESCRIPTION OF A PREFERRED EMBODIMENT

Figure 1:
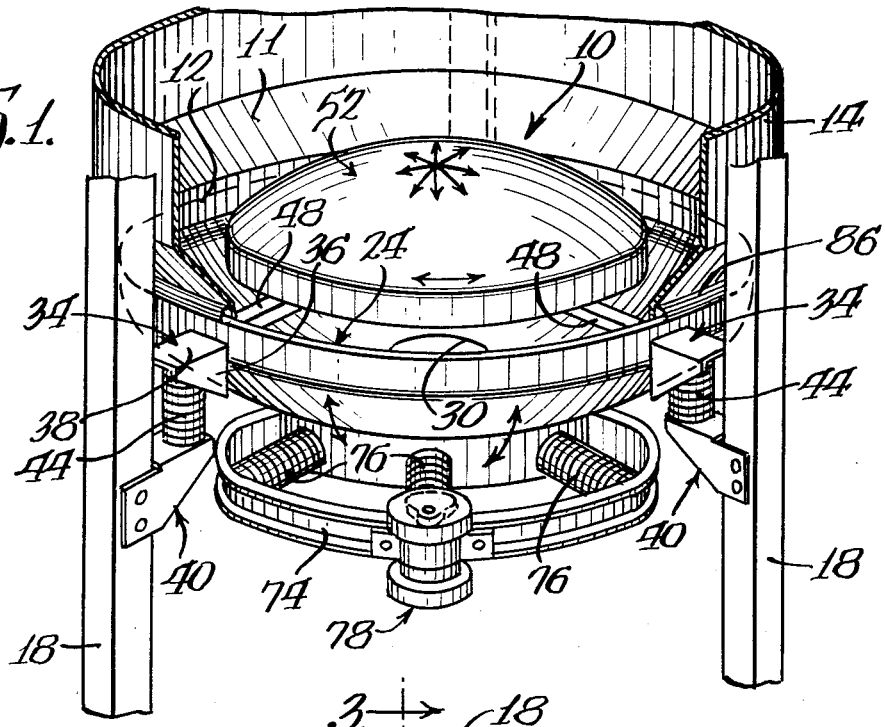
FIG. 1 is a prospective elevational view of the bin activator apparatus with most of the bin or hopper broken away.
Figure 2:
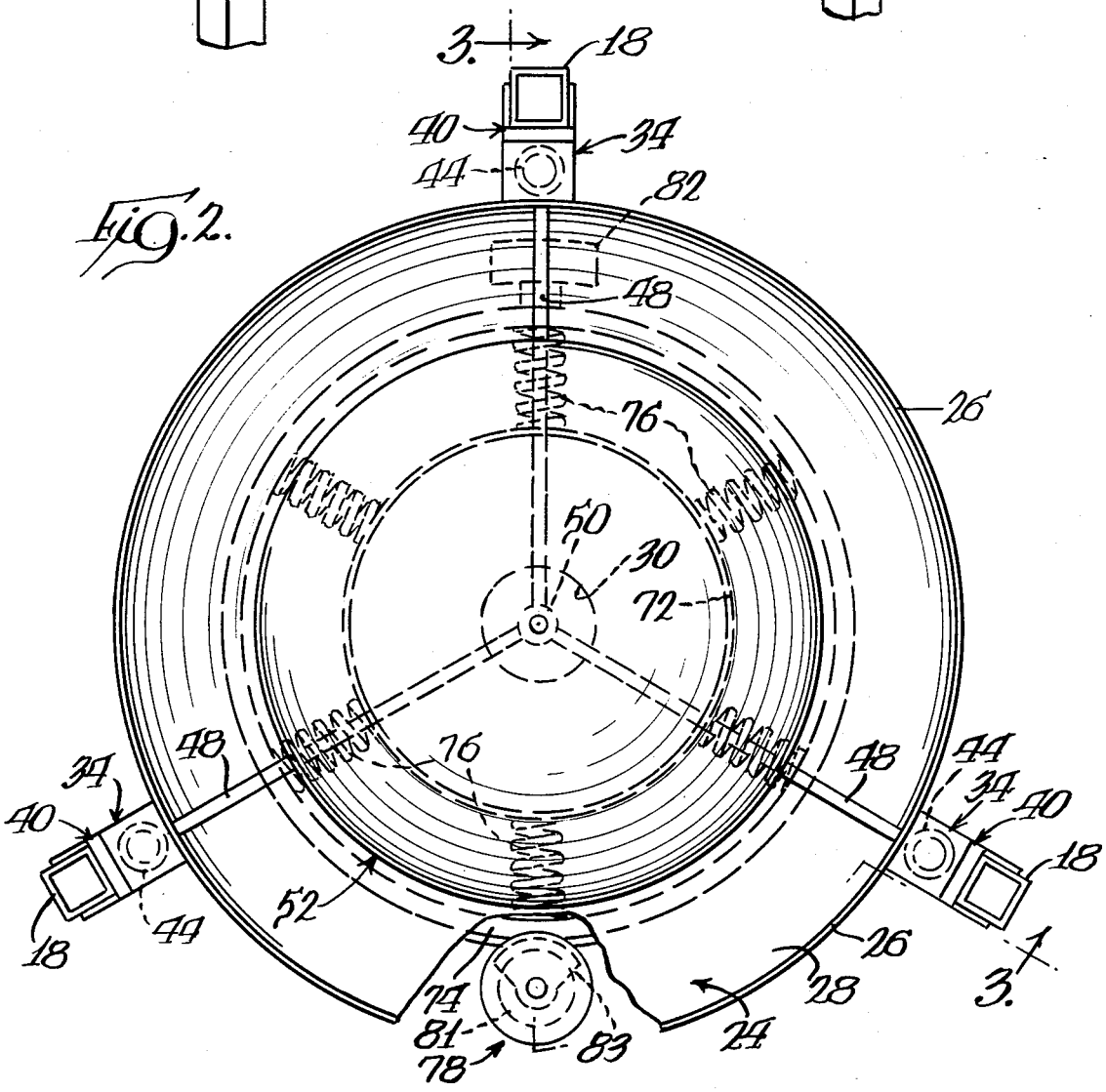
FIG. 2 is a plan view slightly enlarged of the bin activator apparatus of FIG. 1.
Figure 3:
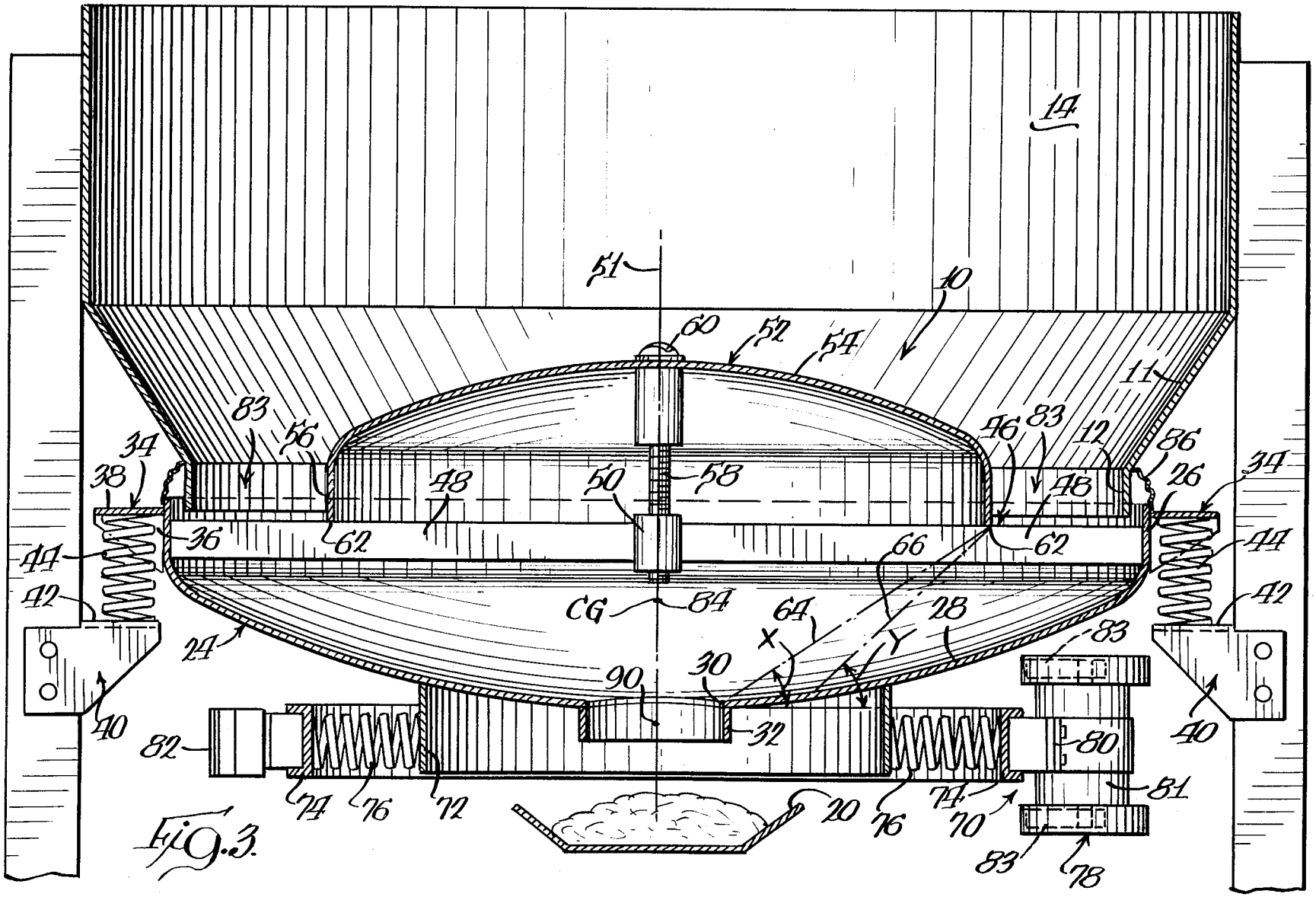
FIG. 3 is a slightly enlarged vertical cross sectional view taken along the line 3—3 of FIG. 2, with a portion of a bin showing.

Referring now to the embodiment of the invention shown in FIGS. 1–6, there is provided a bin activator apparatus 10 to be mounted just below a sloping or cone-shaped portion 11 having a discharge opening 12 (FIG. 3) in a bin or hopper 14. In the form of invention illustrated, the hopper or bin 14 is shown mounted on three vertical supports 18 which would be anchored to the ground in an appropriate fashion. It is contemplated that the bin or hopper could be a permanent structure formed in a base wherein one or more sloping or cone-shaped discharge openings 12 project downwardly into an open portion of a tunnel or passage beneath the material storage area. In the event the bin activator apparatus is mounted in a permanent structure, the bin activator apparatus would be mounted on supports anchored to the walls or to the ground of the structure over which the bin is located. The bin activator apparatus 10 is shown supported on the supports for the bin and is not carried by the bin itself. The activator apparatus 10 could be resiliently mounted on the bin. In one preferred form, the bin activator apparatus 10 has an outlet opening 30 above a continuous conveyor 20 so that a uniform flow or discharge of material is deposited on the conveyor as the conveyor traverses the path below the bin. In the event of a permanent installation, the top of the base will be at ground level with the discharge opening 12 of the bin located just below the ground level and below a dumping place for the particulate material to be handled. The bin or hopper 14 as illustrated in FIG. 3, has the discharge opening 12 discharging into the bin activator apparatus 10 with the outlet opening 30 of the bin activator apparatus aligned with the conveyor 20 for conveying the material discharged from the bin to a subsequent processing location. The bin activator apparatus 10 is for use in moving any pulverulent material from coal to powders and the like.

Figure 7:
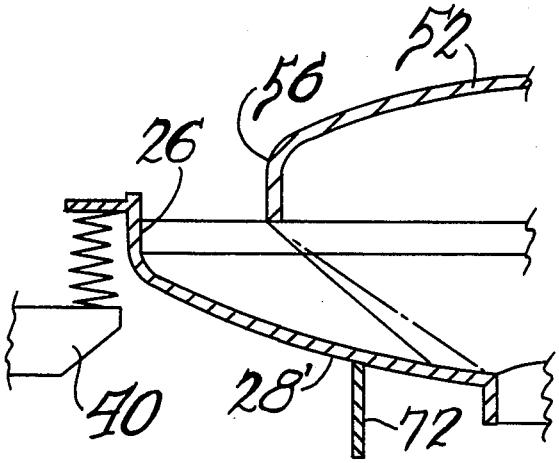
FIG. 7 is a partial broken away cross sectional view of a modified form of bowl having a conical configuration.

The bin activator apparatus 10 is comprised of a bowl-shaped member 24 which has a cylindrical peripheral wall portion 26 and a concave bottom surface 28 sloping downwardly and inwardly toward the outlet opening 30 at the midportion thereof. A cylindrically shaped spout 32 is affixed at the opening 30 and extends downwardly from the bowl. As shown in FIG. 7, it has been found that the concave portion 28 of the bowl could be a conical surface 28' where the angle of the cone is relatively shallow with respect to the horizontal. The tangential angle of the surface 28 of the bowl to the horizontal and the coefficient of friction of the surface coact with the material from the bin to produce a static angle of repose of the material in the at rest position in the bowl such that the material will not flow. The angle of slope of the concave surface 28 or conical surface and the purpose thereof will be described in greater detail hereinafter. Plural support brackets 34 extend radially outward from the cylindrical wall portion 26 of the bowl-shaped member with each bracket comprised of gusset plates 36 and cross plates 38. As shown, three such brackets 34 are illustrated with the brackets being equidistantly spaced apart about the periphery of the bowl. It is to be understood that more than three support brackets could be used without departing from the spirit of the invention. Each support 18 has an inwardly projecting bracket 40 secured thereto, with each bracket 40 having a horizontal plate 42 extending transverse to the support beam 18. Compression springs 44 are mounted between the brackets 34 and 40 so as to resiliently support the bowl 24 of the bin activator apparatus. As mentioned previously, the bowlshaped member 24 could be resiliently mounted to brackets 40 secured to a wall, on separate supports or on the cone-shaped portion of the bin. The walls 26 of the bowl 24 overlap the walls of the discharge opening 12 and have a reasonably uniform and predetermined spacing therebetween for a reason to be described hereinafter.

Figure 5:
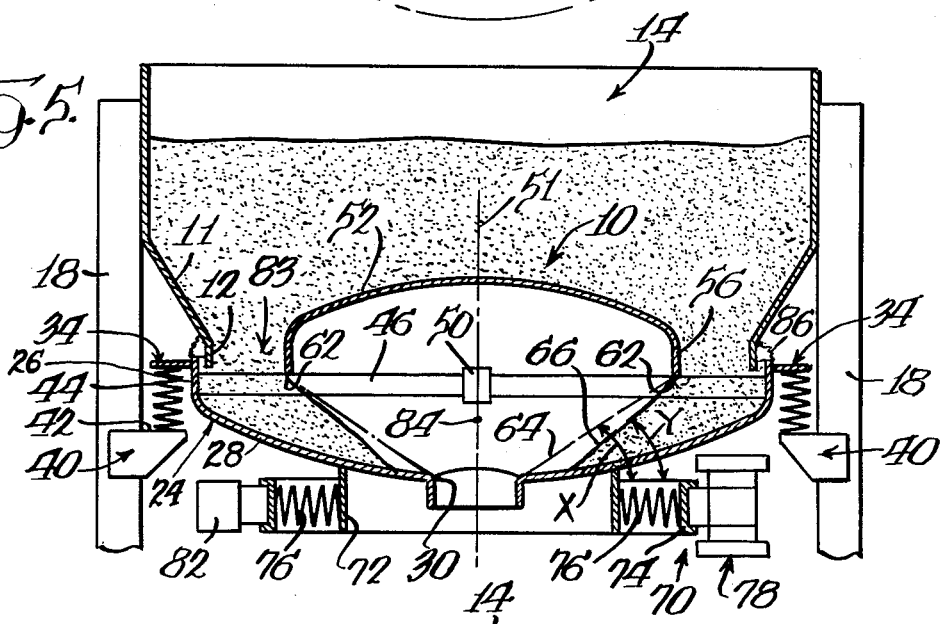
FIG. 5 is a vertical cross sectional view similar to FIG. 3 showing material in the bin or hopper and with the vibration generator at rest so that the flow of material is cut off by the angle of repose of the material in the bowl-shaped member.
Figure 6:
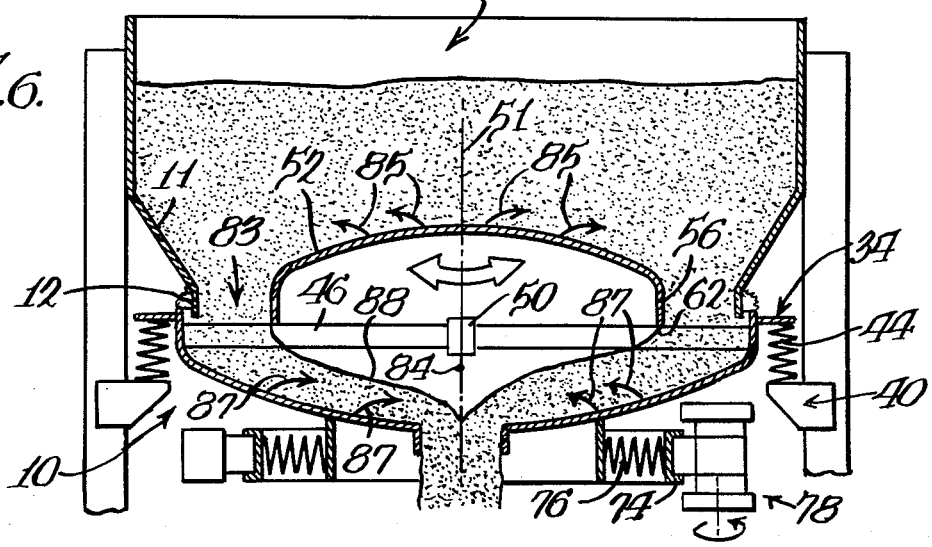
FIG. 6 is a view similar to FIG. 5 only with the vibration generator operating and with arrows illustrating the direction of forces contributing to the flow of material through the discharge outlet.

As shown, a spider-like support structure 46 is affixed to the inside of the peripheral wall portion 26 of the bowl. As shown in FIG. 3, the spider 46 is comprised of three radial arms 48 radiating from a hub 50 with the axis of the hub 50 coinciding with the vertical axis 51 of the bowl 24. It is to be understood that the spider 46 could be a cross-shaped member having two beams intersecting at the hub 50 and being disposed 90° apart. A deflector 52 is supported on the spider 46 and is comprised of a dome-shaped portion 54 which terminates in a downwardly directed sleeve portion 56. The deflector could be cone-shaped or possibly flat, although the dome-shape and cone-shape are preferred. The edges 62 of the sleeve portion 56 rest on the spider 46 with a threaded member 58 threaded through the hub 50 and having a head portion 60 bearing against the dome-shaped portion 54 of the deflector. The threaded member 58 secures the deflector 52 to the spider 46 whereupon the sleeve portion 56 of the deflector is spaced radially inward from the walls of the discharge opening 12 of the bin and are spaced radially outward from the outlet opening 30 of the bowl 24. The lower edge 62 of the deflector 52 is located with respect to the outlet opening 30 of the bowl in such a way that the angle X to the horizontal of a line extending from said lower edge 62 to the edge of the outlet opening 30 is less than the angle of repose Y of material being discharged from the bin. This principle is best shown in FIG. 5 where the line 64 extending from the edge 62 to the opening 30 has an angle X to the horizontal which is less than the angle Y formed by the line 66 drawn along the surface of the material reposing on the bowl 24. In this way in the static condition, the material in the bin and reposing in the bowl, due to the coefficient of friction of the surface and due to the tangential slope of the concave bowl, the material will not flow to the outlet opening so that no cut-offs or gatings are necessary to stop flow of material from the bin.

A vibrator mechanism 70 is carried by the bowl 24 for activating discharge of material from the bin. The vibrator mechanism 70 is attached to the bowl through a cylindrical sleeve-like member 72 attached to the lower portion of the bowl concentrically with respect to the outlet opening 30. An exciter member 74, which is shown circular in configuration with an outwardly opened C-shaped cross section, encircles the sleeve 72 and is connected thereto by a plurality of spring members 76 affixed both to the exciter member 74 and to the sleeve 72. The axes of the springs 76 lie on radii of the exciter 74. A vibration generator 78 is secured by brackets 80 to the exciter member 74. One preferred vibration generator 78 is of the type shown in my U.S. Pat. No. 3, 358,815 whereby the amplitude of the vibrations generated may be varied in order to vary the rate of discharge of the material from the bin. Another type of vibration generating apparatus that is particularly effective with the bin activator apparatus is shown in my co-pending application Ser. No. 420,602, filed Sept. 20, 1982, and entitled vibratory apparatus. In this later type apparatus, a small force can be used to generate a full range of feed control from 0 to maximum. The vibration generator 78 will have the axis of the motor 81 extending vertically with the unbalanced rotor 83 at each end thereof. A counterweight or counterbalance 82 is attached to the exciter 74 at a location diametrically opposite to the vibration generator 78. The counterweight or counterbalance 82 is intended to balance the weight of the vibration generator 78 so that in the static at-rest state, the exciter member 74, vibration generator 78 and counterweight 82 will lie in a plane substantially parallel to the outlet opening 30 in the bowl 24 which plane will be substantially horizontal.

With the vibrator mechanism 70 mounted on the bowl 24 and at rest, the bin activator apparatus 10 will have a center of gravity 84 which will fall on the vertical axis 51 of the bowl 24 between the deflector 52 and the bowl 24. A resilient seal 86 is affixed between the wall 26 of the bowl 24 and the outside surface of the discharge opening 12 of the bin so as to confine dust and the like to the bin 14 and bowl 24.

With material piled in the bin or hopper 14, it will completely fill the discharge opening 12 in the bin and will flow through the gap 83 between the wall 56 of the deflector 52 and the discharge opening 12 of the bin and will form an angle of repose Y between the edge 62 of the deflector 52 and the concave surface 28 of the bowl 24, which angle of repose Y will be greater than the angle X between the line 64 extending from the edge 62 to the edge of the opening 30. In this way, due to the coefficient of friction of the surface acting on the material and due to the angle of the surface to the horizontal, there will be no material flowing through the outlet opening 30 with the bin activator apparatus 10 at rest. When the vibration generator 78 is started, the conditions illustrated in FIGS. 4 and 6 prevail. The angle of repose of the material greatly lessens with the upper surface of the material lying along a path 88 which, because it extends beyond the edges of the opening 30, permits flow of material through the outlet opening 30. That is, the vibration generator 78 attached to the exciter member 74 will start to vibrate and due to the resilient mountings 76 to the bowl 24, will produce a circular orbital vibratory motion to the bowl. This motion, due to the resilient mounting of the bowl by the springs 44 to the supports 18 and due to the fact that the vibrational motion is in a plane below the center of gravity 84 of the bin activator apparatus, will create a pitching motion to the bin activator apparatus about the center of gravity 84 such that the deflector 52 will pitch outwardly (arrows 85) as the surface 28 of the bowl 24 pitches inwardly (arrows 87). In that way, material in the bin in contact with the surface 54 of the deflector will be vibrated outwardly with respect to the deflector 52 in the general direction of the arrows 85 and toward the gap or opening 83 between the deflector 52 and the inside of the discharge opening 12 of the bin. At the same time, material in contact with the surface 28 of the bowl 24 will be pitched or thrown radially inwardly in the direction of the arrows 87 toward the discharge opening 30. The combined effect of the circular orbital vibratory motion and the pitching motion will produce a somewhat cyclonic vibratory motion about the vertical axis of the bin activator apparatus. This will create a cyclonic or vortex pattern to the material on the surface 28 of the bowl 24 as it approaches the outlet 30, causing the material to flow freely and uniformly through the outlet opening 30 onto the conveyor 20. The pitching and orbital vibratory motions will prevent classification or separation of the different sized particles of the material and in the event there has been some previous classification, the motion will tend to mix the material as it is fed through the bin activator apparatus and the outlet opening 30.

Figure 4:
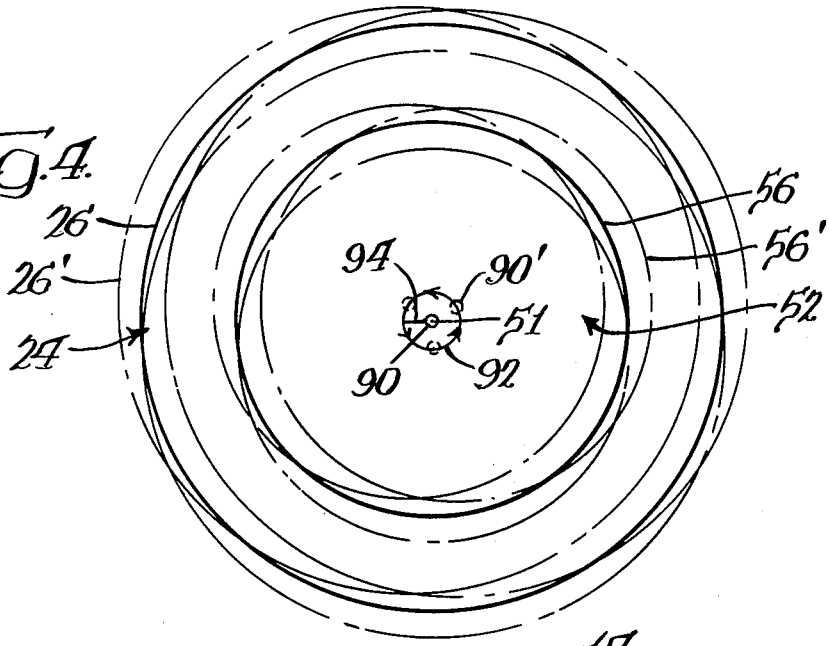
FIG. 4 is a plan view of the outlet opening of the bowl of the bin activator apparatus with the solid lines being the at-rest position and with the dashed lines being progressive orbital motion caused by the vibration generator.

The vibration generator 78 can produce vibration frequencies up to 4,000 cycles per minute or more if the nature of the material justifies. Vibration frequency can be varied as well as the amplitude of the vibrations so as to discharge effectively all different types of material stored in the bin. Referring to FIG. 4, the orbital motion of the bowl 24 created by the vibration generator will cause the center 90 on axis 51 of the outlet opening 30 to subscribe a circle 92 about the initial center 90 of the bin activator apparatus with the amplitude of the orbital motion being the equivalent of the radius 94 of said circle. With the vibration generator 78 operating, the center 90 will move to, for instance, 90′ wherein the wall 26 of bowl member 24 will be at the dashed line position 26′, and the deflector 52 will have its sleeve portion move from 56 to 56′ and so forth. The amplitude of vibration will be something less than the spacing between the wall 26 on the bowl 24 and the outside of the discharge outlet 12 on the bin so that there will be no interference between the bowl and the bin. It has been found that increasing the vibration frequency or amplitude both increases the conveying action and due to the combined pitching and circular orbital vibratory motion, no compacting of material in the bin takes place. It has been found that the relatively small force generated by the vibration generator and exciter will translate into a larger force supplied to the mass of the bowl and will discharge material from the bin uniformly. The system is a two-mass system wherein the one mass is the exciter 74 and the vibration generator 76 with the second mass being the bowl structure, whereby a small vibratory force to the first mass, i.e. exciter and vibration generator, translates into a larger force for the second mass, i.e. the bowl and its contents.

We claim:

1. A bin activator apparatus for moving material from a storage bin having a discharge opening in the bottom thereof, said activator apparatus comprising (a) means for receiving material from the discharge opening of the storage bin and discharging same at a uniform rate, said means having a bottom surface sloping generally downwardly and inwardly toward an outlet opening at the midportion thereof;

(b) a deflector carried by said means and being spaced above said means, said deflector having a lower edge spaced from the side wall of said means and having a center portion above the outlet opening, the angle to the horizontal of a line extending from the lower edge of the deflector to the adjacent edge of the outlet opening being less than the static angle of repose of the material from the bin resting on the bottom surface of said means;

(c) resilient means for supporting said first named means relative to said storage bin, said first named means overlapping with and being in spaced relationship with said discharge opening of the bin;

(d) vibrator means for providing circular orbital vibratory motion to said first named means and to said deflector for discharging a flow of material from said outlet opening; said vibrator means comprises:

(i) exciter means encircling said outlet opening and being resiliently connected to said material receiving means, (ii) a vibration generator and a counterweight mounted diametrically opposite each other on said exciter means whereby the center of gravity of the activator apparatus falls on the vertical axis of said first named means between said first named means and the deflector means; and (iii) said vibration generator and exciter means providing circular orbital vibratory motion in the plane of said outlet opening for moving material toward said outlet opening and providing a pitching vibratory motion about said center of gravity whereby the deflector means vibrates material in contact therewith radially outwardly and the concave surface of the first named means vibrates material in contact therewith inwardly toward said outlet opening.

2. A bin activator apparatus as claimed in claim 1 wherein said first named means is bowl-shaped and a spout encircles said outlet opening to direct the material downwardly.

3. A bin activator apparatus as claimed in claim 2 wherein a conveyor is disposed below said outlet opening for receiving a uniform flow of material as it moves through said outlet opening.

4. A bin activator apparatus as claimed in claim 1 wherein said first named means is cone-shaped with the angle of the wall of the cone to the horizontal being less than the angle of repose of the material in a static state.

5. A bin activator apparatus for moving material from a storage bin having a sloping discharge opening in the bottom thereof, said activator apparatus comprising (a) bowl-shaped means for receiving material from the discharge opening of the storage bin and discharging same onto a conveyor below the apparatus, said bowl-shaped means having a continuous concave bottom surface with an outlet opening at the midportion thereof;

(b) deflector means carried by said bowl-shaped means and positioned above said bowl-shaped means in radially outwardly overlapping relationship with respect to said outlet opening;

(c) means for resiliently supporting said bowl-shaped means in spaced relationship with said sloping discharge opening of the bin;

(d) vibrator means for providing circular orbital motion to said bowl-shaped means and to said deflector means, said vibrator means comprising:

(i) exciter means encircling said outlet opening and being resiliently connected to said bowl-shaped means, (ii) a vibration generator and a counterweight mounted diametrically opposite each other on said exciter means whereby the center of gravity of the activator apparatus falls on the vertical axis of the bowl-shaped means between the bowl-shaped means and the deflector means; and (e) said vibration generator and exciter means providing circular orbital vibratory motion in the plane of said outlet opening for moving material toward said outlet opening and providing a pitching vibratory motion about said center of gravity whereby the deflector means vibrates material in contact therewith radially outwardly and the concave surface of the bowl-shaped means vibrates material in contact therewith inwardly toward said outlet opening.

6. A bin activator apparatus as claimed in claim 5 wherein said vibration generator includes means for varying the vibration frequency transmitted from the vibration generator to the exciter means.

7. A bin activator apparatus as claimed in claim 5 wherein mounting means are fastened below said bowl-shaped means, said exciter means encircles said mounting means and is connected thereto by plural spring means extending radially therebetween.

8. A bin activator apparatus for moving material from a storage bin having a converging discharge opening in the bottom thereof, said activator apparatus comprising (a) means for receiving material from the discharge opening of the storage bin and discharging same at a uniform rate from an outlet opening at the midportion thereof;

(b) a deflector carried by said receiving means and positioned above said receiving means in radially outwardly overlapping relationship with respect to said outlet opening;

(c) resilient means for supporting said receiving means in spaced relationship with said sloping discharge opening of the bin;

(d) vibrator means for providing circular orbital motion to said receiving means and to said deflector, said vibrator means comprising:

(i) exciter means encircling said outlet opening and being resiliently connected to said receiving means, and (ii) a vibration generator and a counterweight mounted on said exciter means on diametrically opposite sides thereof, whereby the center of gravity of the activator apparatus falls on the vertical axis of said receiving means between said receiving means and the deflector;

(e) said vibration generator and said exciter means providing circular orbital vibratory motion in the plane of said outlet opening and providing a pitching vibratory motion about the center of gravity whereby the deflector vibrates material in contact therewith in a generally radially outward direction and said receiving means vibrates material in contact therewith inwardly toward said outlet opening whereby material in said bin will be discharged at a substantially uniform rate from said outlet opening.

9. A bin activator apparatus as claimed in claim 8 wherein the receiving means is a bowl-shaped member with a concave bottom surface sloping toward the outlet opening, and wherein said surface has a coefficient of friction and has a tangential angle relative to the horizontal which combine to prevent free flow of the material across the surface when the vibration generator is at rest.

10. A bin activator apparatus as claimed in claim 9 wherein said bowl-shaped member is supported independently of said bin and said resilient means for supporting said member are a plurality of equally spaced springs extending vertically between the periphery of the bowl-shaped member and brackets mounted on supports.

* * * * *